US006014080A

United States Patent [19]

Layson, Jr.

[11] Patent Number: 6,014,080

[45] Date of Patent: Jan. 11, 2000

[54] BODY WORN ACTIVE AND PASSIVE TRACKING DEVICE

[75] Inventor: Hoyt M. Layson, Jr., Palm Harbor, Fla.

[73] Assignee: Pro Tech Monitoring, Inc., Palm Harbor, Fla.

[21] Appl. No.: 09/181,244

[22] Filed: Oct. 28, 1998

[51] Int. Cl.[7] ..... G08B 23/00

[52] U.S. Cl. ..... 340/573.1; 340/573.4; 340/539; 342/357.07; 701/212

[58] Field of Search ..... 340/573.1, 573.3, 340/573.4, 539, 825.36, 825.46, 825.49, 357.02, 357.07, 357.08, 357.09; 342/357; 701/211, 212, 213

[56] References Cited

U.S. PATENT DOCUMENTS

| | | | |
|---|---|---|---|
| 4,438,491 | 3/1984 | Constant | 701/106 |
| 5,345,244 | 9/1994 | Gildea et al. | 342/357 |
| 5,373,531 | 12/1994 | Kawasaki | 375/1 |
| 5,497,149 | 3/1996 | Fast | 340/988 |
| 5,504,684 | 4/1996 | Lau et al. | 340/988 |
| 5,528,248 | 6/1996 | Steiner et al. | 342/357 |
| 5,535,237 | 7/1996 | LaPadula, III et al. | 375/200 |
| 5,625,668 | 4/1997 | Loomis et al. | 455/456 |
| 5,627,548 | 5/1997 | Woo et al. | 342/357 |
| 5,652,570 | 7/1997 | Lepkofker | 340/573.4 |
| 5,663,734 | 9/1997 | Krasner | 342/357 |
| 5,712,619 | 1/1998 | Simkin | 340/539 |
| 5,714,931 | 2/1998 | Petite et al. | 340/539 |
| 5,731,757 | 3/1998 | Layson, Jr. | 340/573.1 |
| 5,731,785 | 3/1998 | Lemelson et al. | 342/357 |
| 5,742,233 | 4/1998 | Hoffman et al. | 340/573.1 |
| 5,742,509 | 4/1998 | Goldberg et al. | 701/211 |
| 5,773,993 | 6/1998 | Trimberger | 326/38 |
| 5,825,327 | 10/1998 | Krasner | 342/357.09 |
| 5,831,574 | 11/1998 | Krasner | 342/357.8 |
| 5,838,237 | 11/1998 | Revell et al. | 340/573.1 |
| 5,867,103 | 2/1999 | Taylor, Jr. | 340/573.4 |
| 5,884,214 | 3/1999 | Krasner | 701/207 |
| 5,905,461 | 5/1999 | Neher | 342/357.07 |

OTHER PUBLICATIONS

U.S. application No. 09/082,313, Layson, Jr., filed May 20, 1998.

*Primary Examiner*—Jeffery A. Hofsass
*Assistant Examiner*—Van T. Trieu
*Attorney, Agent, or Firm*—Larson & Larson, P.A.; James E. Larson

[57] ABSTRACT

Tamper resistant body-worn tracking device to be worn by offenders or potential victims for use in a wireless communication system receiving signals from a global positioning system (GPS). The tracking device directly communicates spacial coordinates to multiple remote sites. The tracking device is an enclosed case worn on a limb of a person. The case contains a battery, a signaling device, and a circuit board containing a field programmable gate array, a wireless data modem, a conventional GPS receiver, and a matched filtering GPS receiver.

16 Claims, 4 Drawing Sheets

BODY WORN ACTIVE AND PASSIVE TRACKING DEVICE

BACKGROUND OF THE INVENTION

1. Field of the Invention

This invention relates to electronic monitoring and tracking of persons. More particularly, it refers to providing an all body worn low power active tracking apparatus integrated with a wireless network and central data base system resulting in advanced warning to victims, delivery of immediate instructional commands to offenders, and timely notification to an offender supervising and/or law enforcement agency should an offender and victim come within an unallowable proximity of one another or should the apparatus tracking the offender detect a violation or become disabled resulting in loss of contact with the offender's and/or victim's tracking apparatus.

2. Description of Prior Art

Currently, determining the location of a person or subject, such as an offender or victim, is possible outside the confines of their respective residence. An apparatus for determining such location is described in U.S. Pat. No. 5,731,757. This apparatus employs a tamper resistant body worn ankle wireless transmitter communicating with an associated tamper resistant portable tracking apparatus which must be carried by the offender. The portable tracking apparatus determines its location using Global Positioning System (GPS) satellites. The portable tracking apparatus communicates with a central data base system using wireless communications when portale and using land-line communications when placed in a charging stand at the subject's residence or work location. Algorithms in the offender's portable tracking apparatus executing on the processor compare the offender's current location against a schedule of location rules stored in the memory of the offender's portable tracking apparatus. The purpose of a two part tracking device is to place the low power transmitter tag device as the body won component and the high power consumption devices (i.e. GPS receiver card, processor and memory card and wireless transceiver and data modem card) as an integrated portable unit that requires periodic recharging. The body worn transmitter tag device does not require battery recharging or replacement for extended time periods. If the subject forgets to transport the portable tracking device as the subject's location changes (i.e. from home to work), then the ability to track the subject is lost.

When the offender's portable tracking apparatus detects that the offender has violated a safety perimeter established at a static location for the victim, such as the victim's home or work location, the offender's portable tracking apparatus establishes a wireless communications connection with the central data base system to report the violation when in active tracking mode. The central data base system in turn communicates with the offender's supervising agency, law enforcement agency and the victim's portable tracking apparatus by a wireless communications connection to notify the supervising agency, law enforcement agency and victim of the violation. This frequent communication in order to establish offender or victim location is referred to as "active tracking" as opposed to "passive tracking" which is a batch download of the subject's movements during a period of time such as daily when the offender returns to his or her residence and has access to a land line telephone.

Current conventional GPS offender tracking receivers are board level products comprised of multiple integrated circuit chips. Multiple integrated circuit chips consume more power than a single integrated circuit chip with the combined capabilities of the individual integrated circuit chips. Conventional GPS receivers can determine location (latitude and longitude) outdoors and indoors (such as vehicles and buildings) provided there is a window with a clear view of the sky within several feet of the GPS receiver's antenna.

Clearly, size, weight and power are critical requirements for any body worn tracking device. Recent technology affords the ability to combine the body worn transmitter with the portable tracking device described in U.S. Pat. No. 5,731,757 to provide an all body worn device and provide small size and low weight. Other recent technology affords a low power body worn tracking solution through semiconductor SOI technology, matching filter GPS receiver techniques, connectionless oriented digital wireless communication services, miniature watch crystal type GPS antenna and current miniaturized processor and memory devices.

U.S. Pat. No. 5,497,149 describes a body worn locating device that is recharged using a plug in wire battery charging interface to an external power source such as a wall power outlet. With technology known at the time of U.S. Pat. No. 5,497,149 the device described in this Patent, if constructed, would require large batteries and frequent batters recharging or battery replacement due to the amount of power consumed from conventional GPS receivers and cellular phone calls to periodically determine the location of the subject wearing the device, especially where unwilling subjects such as released criminal offenders are wearing the locating device and frequent (i.e. several times an hour) location points are desired. Other personal tracking devices found in U.S. Pat. No. 5,712,619, U.S. Pat. No. 5,742,509, U.S. Pat. No. 5,742,233, U.S. Pat. No. 5,528,248, U.S. Pat. No. 5,731,785, U.S. Pat. No. 5,714,931, U.S. Pat. No. 5,731,785 and U.S. Pat. No. 5,625,668 do not address the low power technology required to implement a non removable body worn locating device in a small, lightweight form factor that is either rechargeable using non contacting external power sources or can function for extended periods of time on a replaceable battery.

There exists a need to combine the functionality of the tamper resistant portable tracking apparatus and the body worn ankle transmitter described in U.S. Pat. No. 5,731,757 and the functionality described in applicant's U.S. patent application Ser. No. 09/082313 into a single body worn tamper resistant apparatus that is capable of being powered for long time periods on the subject's body without the need of assistance by the subject wearing the apparatus attaching an external power source to the apparatus.

In the case of small size, light weight and low power, there exists a need for a high density low power FPGA integrated circuit for the discrete digital functions of processor, memory, serial/parallel communications, analog input/output and digital input/output. In the case of assured message delivery, end-to-end verification of data delivery is needed to assure victims are warned, supervising and law enforcement agencies are notified and the central data base system stores offender and victim location, health and status data, especially where violations have occurred.

SUMMARY OF THE INVENTION

The problem of implementing an all body worn active tracking device which is small, lightweight and can be powered by rechargeable or replaceable rechargeable batteries is solved by this invention. By employing significantly reduced power consumption of subsystems required for active and passive body worn tracking, the present invention produces an all body worn self rechargeable tracking device using replaceable rechargeable batteries.

The high power consumption manner of determining the location, health and status (i.e. performing a heartbeat function) of an active tracking apparatus by a central data base system using connection oriented wireless service (i.e. a cellular phone call) is solved by this invention using lower power consuming connectionless oriented analog or digital wireless service.

By using very low power matching filter GPS receivers providing GPS almanac data every hour by a connectionless oriented wireless message, the power required to determine location using GPS receivers can be reduced by one to two orders of magnitude.

Significant power and size reductions are achieved by integrating several integrated circuit chip devices such as processor, memory, serial input/output, digital input/output, etc. on a field programmable gate array (FPGA) versus implementing discrete logic integrated circuits on a circuit board. Further power savings of up to 35% are achieved by implementing all integrated circuits in low power SOI versions of the integrated circuits.

This invention further provides an all body worn low power passive tracking apparatus that when integrated with a wireless communications interface, transfers the location movement history stored in the passive tracking apparatus to a central data base system.

BRIEF DESCRIPTION OF THE DRAWINGS

The invention can best be understood by those having ordinary skill in the art by reference to the following detailed description when considered in conjunction with the accompanying drawings in which.

DETAILED DESCRIPTION

Figure 1:
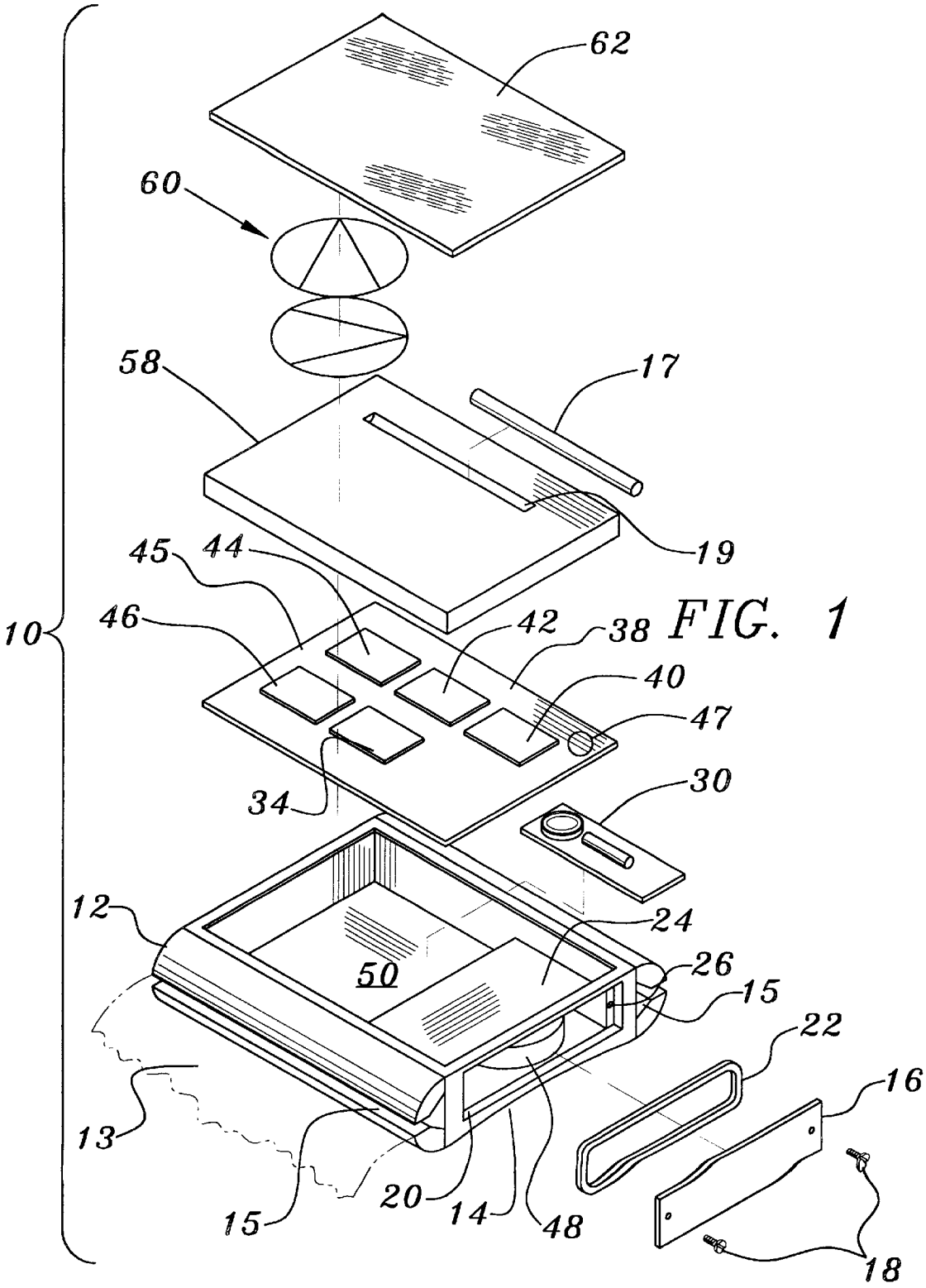
FIG. 1 is an exploded view of the major subsystems in the body worn active or passive tracking device.
Figure 3:
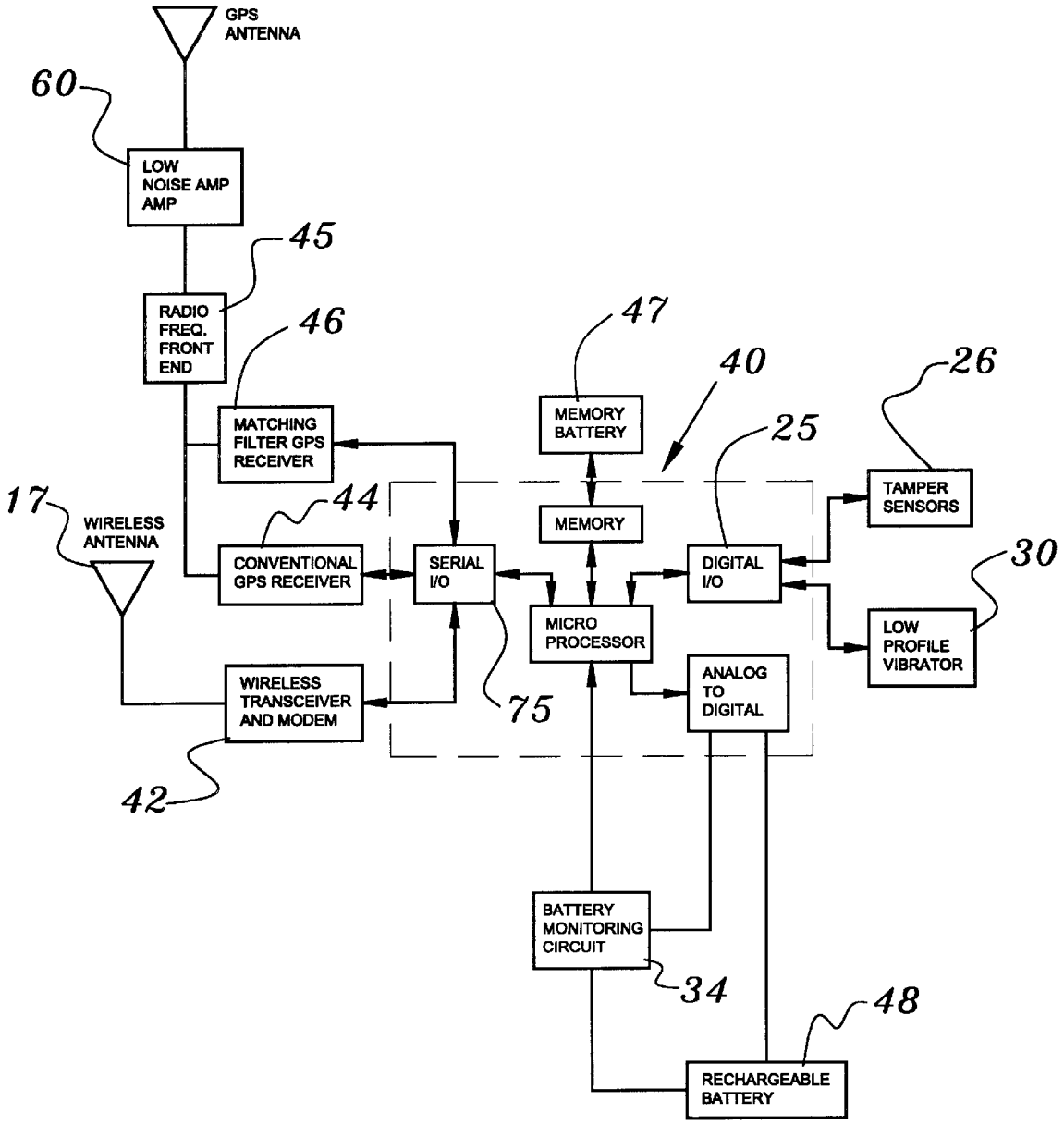
FIG. 3 is a functional block diagram of the body worn device subsystems and interfaces.
Figure 4:
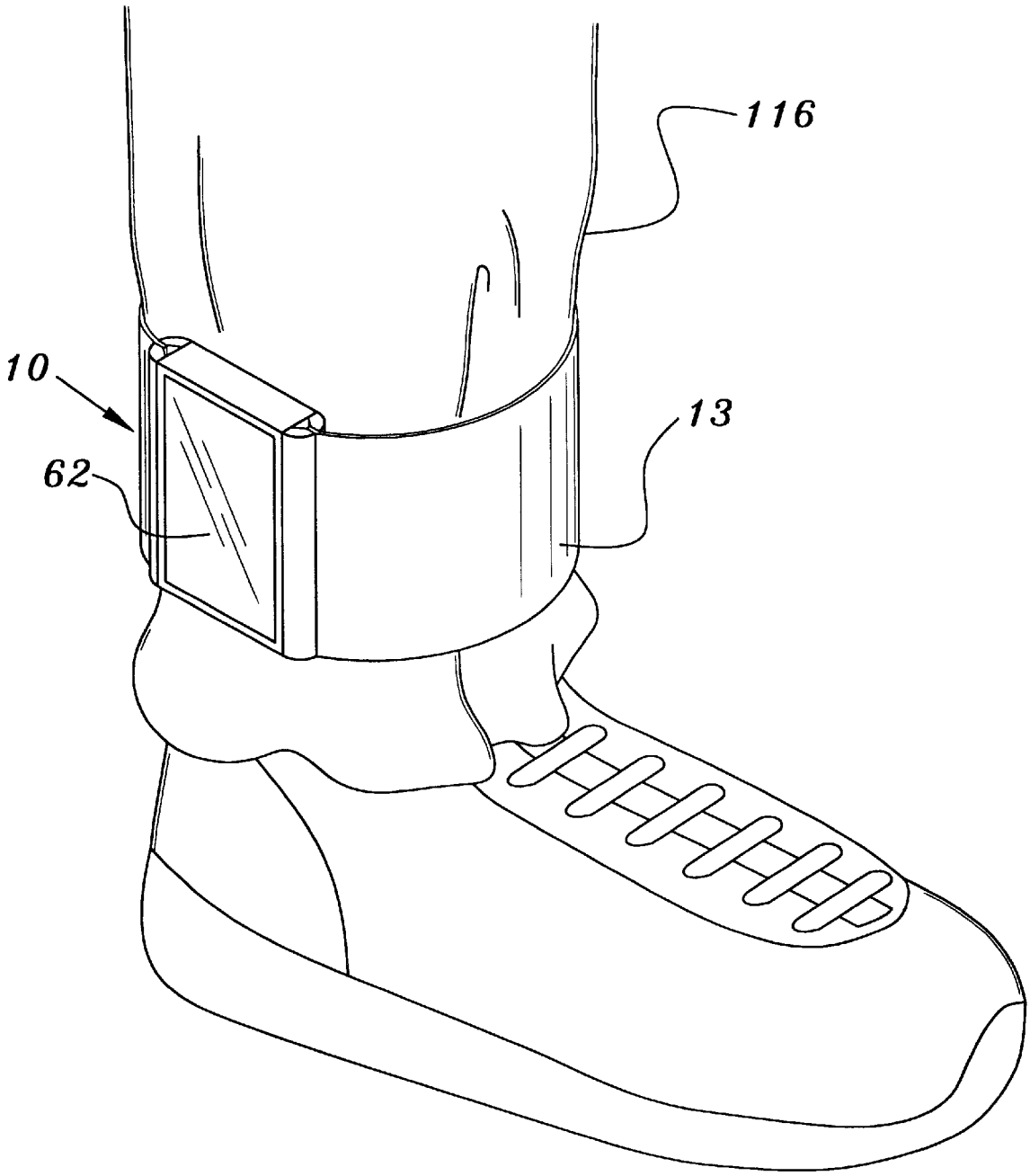
FIG. 4 is the body worn device mounted on an offender's leg.

Throughout the following detailed description, the same reference numerals refer to the same elements in all figures. The functional operations contained in the body worn tracking device processor and memory depicted in FIG. 3 is described by U.S. Pat. No. 5,731,757 and the present inventor's copending U.S. patent application titled: OFFENDER AND VICTIM COLLISION AVOIDANCE AND ADVANCED WARNING SYSTEM (Ser. No. 09/082313). These disclosures are herein incorporated by reference. The body worn tracking device described by FIG. 1 is the integration of the portable tracking device and the body worn transmitter described by U.S. Pat. No. 5,731,757 into a single body worn tracking device. FIG. 1 depicts the body worn tracking device 10 and component subsystems. The body worn tracking device case 12 is made from a high impact plastic that has low attenuation properties for wireless frequencies from 800 MHZ to 1600 MHZ to permit incorporation of an enclosed high efficiency stub loop wireless antenna 17.

The body worn tracking device case 12 contains retaining slots 15 for the adjustable attaching strap 13 as is known in the art and electrical connections to implement tamper detection as described by the inventor's copending U.S. patent application Ser. No. 08/863158 and is incorporated herein by reference. The body worn tracking device case incorporates a curved radius 14 on the side adjacent to the body to conform to the shape of the subject's leg.

A rechargeable and replaceable battery 48 is retained within compartment 24 by a battery cover 16, held in place by tamper resistant screws 18 as is known in the art. The rechargeable replaceable battery 48 is an off the shelf item and is recharged in an off the shelf charging stand. Lithium family batteries such as lithium metal or lithium polymer are used for their charge/mass efficiency ratios and flat voltage discharge profile. The battery cover 16 fits inside a recessed flange 20 and the pressure exerted by the tamper resistant battery cover screws 18 when tightened compresses the soft durometer continuous O-ring 22 to form a water tight seal. The battery cover 16 is flush with the outside dimension of the body worn tracking device case 12 when the tamper resistant battery cover screws 18 are tightened properly. A sealed battery compartment 24 is formed inside the body worn tracking device case 12 with the only opening being sealed by the O-ring 22 and battery cover 16. Tamper detection screw threads 26 in the body-worn tracking device case 12 cause a break in continuity when the tamper resistant screws 18 are loosened.

A low profile vibrator 30 as known in the wireless pager industry art is incorporated inside the body worn tracking device case 12 as a low power notification device for the subject. An example of a low profile vibrator is described in U.S. Pat. No. 5,554,971 and incorporated herein by reference. The low profile vibrator 30 is used to notify the subject for conditions and violations in lieu of audible tones provided by prior art portable tracking devices.

The main circuit board 38 is stiffened and the components staked as is known in the art to provide a rugged design to withstand shocks generated by leg motion and impacts with objects.

A field programmable gate array 40 (FPGA) as is known in the art is employed to integrate the major analog and digital components comprising the processing board in the portable tracking device described in U.S. Pat. No. 5,731,757. Prior to U.S. Pat. No. 5,773,993, the process of programming complex devices, such as a microprocessor, into a FPGA would have been cost and time prohibitive. The domain implementation described in U.S. Pat. No. 5,773,993 allows programming a complex device into a FPGA by including a previously developed software library for the complex device as is known in the art. Today with a 500,000 gate XYLINX FPGA, the exact microprocessor, memory, serial I/O, digital I/O, analog to digital converters and associated glue logic chips, as is known in the art, of the processor board described in U.S. Pat. No. 5,731,757 can be implemented in a single FPGA. The power savings realized by implementing the body worn tracking device 10 digital and analog logic in an FPGA is 50% to 70% by known industry standards. This power savings is achieved by using gate level interconnects as opposed to chip level interconnects. Chip level interconnects are designed by the manufacturer for "worst case" loads and path length capacitance charging/discharging effects which results in high power interface gates for each connection on the chip.

A small memory battery 47 retains the program and data in the memory of the FPGA 40 as a backup in case the replaceable rechargeable battery 48 becomes totally discharged or when the rechargeable battery is replaced.

Wireless data modem 42 application specific integrated circuits (ASIC) developed for cellular phones and personal communication service (PCS) devices offer a small form factor such as PCMCIA as is known in the art and low standby power consumption. These ASICs also include Transport Connection Protocol/Internet Protocol (TCP/IP) to facilitate power saving connectionless oriented wireless message protocols such as cellular data packet delivery (CDPD) as is known in the art.

A conventional GPS receiver 44 implemented on a single digital signal processing (DSP) integrated circuit is described in U.S. Pat. No. 5,535,237 and a single integrated circuit (IC) is described in U.S. Pat. No. 5,504,684 and they are incorporated herein by reference. By implementing tracking and acquiring global positioning system (GPS) signals from multiple satellites on a single integrated circuit, significant power savings are achieved as in the case of an ASIC integrated circuit and a FPGA integrated circuit. The conventional GPS receiver is utilized to acquire updates to the GPS almanac whenever wireless updates are not available.

A matched filtering GPS Receiver 46 implemented on a single DSP integrated circuit is described by U.S. Pat. No. 5,663,734 and incorporated herein by reference. This matched filtering GPS receiver incorporates the following power saving features; 1) Fast Fourier Transform (FFT) algorithms that are 10 to 100 times faster than traditional computational approaches, 2) DSP or FPGA single integrated circuit implementation, and 3) instant location fix upon power up of the radio frequency front end allowing the power down of the GPS receiver to achieve a typical less than 0.01% GPS receiver duty cycle or a two orders of magnitude reduction in power consumed by a conventional GPS receiver.

A GPS radio frequency (RF) front end 45 is implemented on a single integrated circuit (IC) as is known in the art and a single IC RF transceiver has been described in U.S. Pat. No. 4,438,491. A single RF front end 45 is used for the matched filtering GPS receiver 46 and the conventional GPS receiver 44 cutting RF front end stand-by power in half and reducing the size and weight of the body-worn tracking device 10.

The main circuit board 38 in the body worn tracking device 10 incorporates the embodiment of the processor card, GPS receiver card and wireless cellular transceiver card described for the portable tracking device in U.S. Pat. No. 5,731,757. The main circuit board also supports wireless data protocols such as TCP/IP and connectionless oriented wireless IP packets (also known as user datagram packets or UDP). All analog, RF and digital circuitry for the body worn tracking device 10 is realized on the form factor of the main circuit board 38 requiring a small board cavity 50 in the portable tracking device case 12.

A cellular high efficiency stub loop antenna 17 described in U.S. Pat. No. 5,485,165 is incorporated herein by reference. The high efficiency stub loop antenna 17 is placed in the antenna cavity 19 formed in the bulkhead 58. The high efficiency saves power by achieving more reliable RF wireless communications and reducing the need for power consuming retries to complete successful RF wireless data transfer to and from the body worn tracking device 10.

A small, thin, transparent GPS antenna 60 with an integrated low noise amplifier is located over bulkhead 58. The GPS antenna 60 is described by U.S. Pat. No. 5,345,244 and U.S. Pat. No. 5,627,548 and is incorporated herein by reference. The form factor of this antenna minimally increases the thickness dimension of the body worn tracking device 10.

A high impact clear plastic cover 62 protects the GPS antenna 60 without attenuating GPS signals. The bulkhead 58 and high impact plastic clear cover 62 are attached and sealed to the body-worn tracking device case 12 with epoxy forming a waterproof seal for the internal components.

The combination of, 1) dramatically lowering power consumption using power saving technology devices, 2) power saving cycling techniques, and 3) high efficiency stub loop wireless antenna make an active all body-worn tracking device 10 operational for extended periods of time. The extended time of operation permits the supervising agency to be responsible for battery replacement in the body-worn tracking device 10 for high risk subjects and also removes risks associated with connecting external power to the body-worn tracking device 10 while being worn by the subject (i.e. offender 116 or victim 118).

The combination of, 1) a thin transparent GPS antenna 60, 2) a processor board 38 with memory on a FPGA chip 40, GPS receivers 44, 46 on an ASIC and DSP chip, 3) a RF front-end 45 on a single integrated circuit, 4) integrated circuits in a PCMCIA form factor wireless data modem 42 and 5) a low profile vibrator notification device 30 permit the body-worn tracking device 10 to be packaged in a small form factor and be a lightweight device. The light weight and small form factor of the body-worn tracking device 10 is very significant since there will be less interference with occupational duties and less fatigue for the subject (i.e. offender 116 or victim 118) wearing the body-worn tracking device 10.

Figure 2:
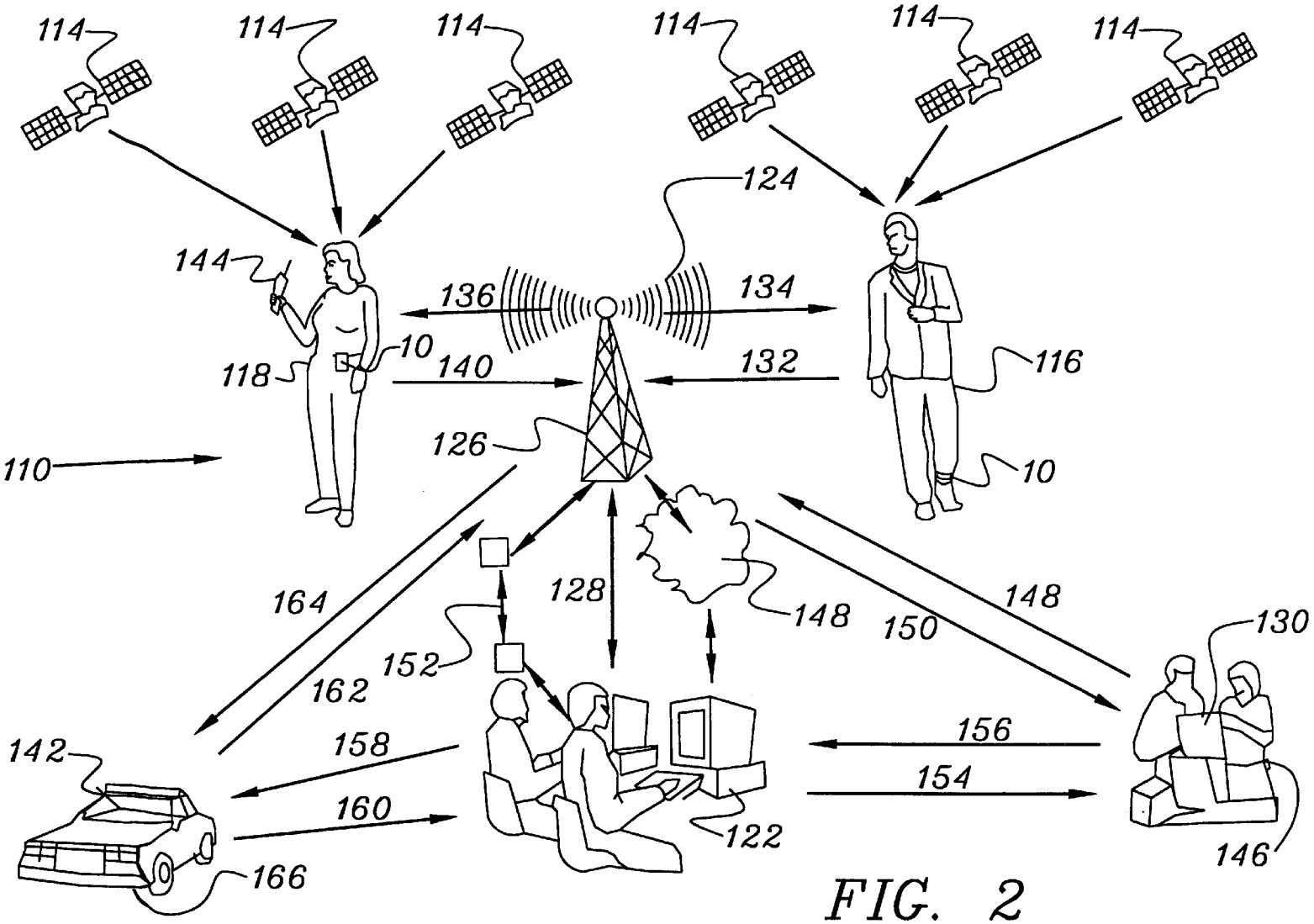
FIG. 2 is a diagram describing the major elements of the system incorporating the body worn active or passive tracking apparatus in a mobile environment.

FIG. 2 illustrates the overall end-to-end system 110 incorporating an offender body-worn tracking device 10 or victim 118 body-worn or clip-on tracking device 10 which receives communication signals from a Global Positioning Satellite (GPS) 114 to determine the location of the subject (offender 116 or victim 118). When continuous location of the offender is desired, the offender 116 is fitted with the body-worn tracking device 10 which is non-removable by the offender 116 and provides tamper detection to generate alarms should the offender 116 attempt to remove the body-worn device 10. When the continuous location for the victim 118 is desired, the victim 118 can be provided a body-worn or a garment clip-on version of the body-worn tracking device 10.

Tamper detection in the offender's body-worn tracking device 10 and offender violation of location constraints will generate a vibrating alarm 30 on the offender's body-worn tracking device 10. When the offender is mobile, the offender would be required to either carry a notification pager or call a specified phone number in order to be informed of the nature of the body-worn tracking device 10 vibrating notification. The offender's body-worn tracking device 10 forwards the alarm to the central data base system 122 through notification devices 142, 144, 146 and any associated victim body-worn or clip-on tracking devices 10 via the wireless link 132. The wireless network mobile switching office 126 processes the wireless signal and switches the communication through the mobile switching office to the central data base system 122 and any associated victim body-worn or clip-on tracking devices 10.

The mobile switching office uses wireless communications 132,134,136,140,148,150 through a network cell site 124 to provide communications between the offender's body-worn tracking device 10 and wireless personal communication service (PCS) notification devices such as digital cellular phones 144, mobile data terminals 142 and digital alphanumeric pagers 146. The mobile switching office 126 uses either the public switched telephone network (PSTN) 128, a private network connection 152 or the Internet 148 as is known in the prior art to provide communications between the body-worn tracking devices 10 and the central data base system 122. The mobile switching office 126 uses wireless communications 132,134,136,140 through a network cell site 124 to provide communications between two or more body-worn tracking devices 10. Mobile switching office 126 uses wireless communications 132,164 through a network cell site 124 to provide communications between an offender's body-worn tracking device 10 and law enforcement's mobile data terminal 142. The wireless mobile switching office 126 uses wireless communications 132,150 through a network cell site 124 to provide communications between an offender's body-worn tracking device 10 and the supervising agency's notification device 146. The wireless mobile switching office 126 uses wireless communications 140,164 through a network cell site 124 to provide communications between a victim's body-worn or clip-on tracking device 10 and law enforcement's mobile data terminal 142. The wireless mobile switching office 126 uses wireless communications 140,150 through a network cell site 124 to provide communications between a victim's body-worn or clip-on tracking device 10 and the supervising agency 130.

The central data base system 122 communicates 154,156 with the supervising agency 130 using lease line, dial up or Internet. The central data base system 122 communicates with law enforcement 166 using land mobile dispatch radio interfaces or other wireless services 158,160 that support message packets.

The communications from the offender's body-worn tracking device 10 is routed to the central data base system 122 where response decisions for notification to the supervising agency (i.e. parole and probation, etc.) 130, victims 118 and law enforcement 142 are made based on offender schedule rules and location constraints defined by the supervising agency 130 and communicated 156 to the central data base system 122.

The central data base system 122 communicates to the offender's body-worn tracking device 10 via the wireless communication link 134 or a telephone land-line when in communication range of the residence interface unit in order to load updated schedule rules and location constraints either new or modified. The central data base system 122 communicates to the victim's body-worn or clip-on tracking device 10 via the wireless communication link 140 in order to facilitate notifications from the supervising agency 130 and law enforcement 166. The central data base system 122 communicates to body-worn tracking devices 10 to load updates to the operating programs, schedule rules and location constraints for offenders 116. The central data base system 122 communicates to a victim's body-worn or clip-on tracking devices 10 to load updates to the operating programs and safety parameters for victims 118.

The offender's body-worn tracking device 10 transmits location, health and status to the central data base system 122 using connectionless oriented wireless digital message packets 132,128,148,152 at intervals defined by the supervising agency 130 and with the intervals communicated 156 to the central data base system 122 where they are uploaded to the offender's body-worn tracking device 10. The offender's body-worn tracking device 10 transmits location, health and status to the victim's body-worn or clip-on tracking device 10 using connectionless oriented wireless digital message packets 132,136 at intervals defined by the supervising agency 130 and with the intervals communicated 156 to the central data base system 122 where they are uploaded to the offender's body-worn tracking device 10. The victim's body-worn or clip-on tracking device 10 transmits location, health and status to the central data base system 122 using connectionless oriented wireless digital message packets 140,128,148,152 at intervals defined by the supervising agency 130 and with the intervals communicated 156 to the central data base system 122 where they are uploaded to the victim's body-worn or clip-on tracking device 10. The victim's body-worn or clip-on tracking device 10 transmits location, health and status to the offender's body-worn tracking device 10 using connectionless oriented wireless digital message packets 134 at intervals defined by the supervising agency 130 and with the intervals communicated 156 to the central data base system 122 where they are uploaded to the victim's body-worn or clip-on tracking device 10.

The offender's body-worn tracking device 10 transmits rule violations using connectionless oriented analog or digital wireless messages to;

the supervising agency's notification device 132,150, the law enforcement agency's notification device 132, 164, the central data base system 132,128,148,152 and the victim's notification device 132,136.

The victim's body-worn or clip-on tracking device 10 transmits notifications resulting from dynamic collision avoidance processing using connectionless oriented analog or digital wireless messages to:

the supervising agency's notification device 140,150, the law enforcement agency's notification device 140, 164, and the central data base system 140,128,148,152.

Law enforcement 166 can contact the victim through wireless communication 162 and 136.

FIG. 3 depicts the block diagram of the body-worn tracking device. The field programmable logic array 40 integrates the microprocessor, memory, digital input/output, analog to digital, and serial input/output. The memory is protected by a memory battery 47 should the rechargeable battery 48 become depleted or during rechargeable battery replacement. The replaceable battery voltage is monitored by the battery monitoring circuit 34.

The low profile vibrator 30 is controlled with the digital I/O 25 section of the FPGA 40.

The tamper sensors 26 are read with the digital I/O 25 section of the FPGA 40.

The radio frequency (RF) front-end 45 supplies the matched filtering GPS receiver 46 and the conventional GPS receiver 44 with received GPS signals from the GPS antenna and low noise amplifier 60. The wireless transceiver and data modem 42 is connected to the stub loop antenna 17 and the serial communications section 75 of the FPGA 40.

When the body worn tracking device 10 is in passive mode it will download location movement history at one or more predetermined times of day significantly reducing the power consumed in active mode when the frequent periodic heartbeat updates are performed multiple times per hour.

Equivalent elements can be substituted for the elements employed in this invention to obtain substantially the same results in substantially the same way. Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

Having thus described the invention what is claimed and desired to be secured by Letters Patent is:

1. A tamper resistant body-worn tracking device worn on a limb of an offender for use in a wireless communication system receiving signals from a GPS and directly communicating spacial coordinates to multiple remote sites, the body-worn tracking device comprising (a) a sealed enclosed case containing means for implementing tamper detection;

(b) a main battery enclosed by the case;

(c) a signaling device enclosed by the case;

(d) a means to replace the main battery;

(e) a circuit board enclosed by the case having attached on the circuit board, a wireless data modem, a GPS receiver having a means to acquire updates to a GPS almanac, a matched filtering GPS receiver, an RF front end connected to the GPS receiver and matched filtering GPS receiver and a field programmable gate array; and (f) the body-worn tracking device in contact with a central station computer containing an algorithm for comparing a current location of the body-worn tracking device to a schedule of rules and location restraints to determine if a static violation has occurred.

2. A body-worn tracking device according to claim 1 containing a battery monitoring circuit.

3. A body-worn tracking device according to claim 1 wherein the means for implementing tamper detection are battery cover screws that actuate an alarm to a central data base if removed from contact with the case.

4. A body-worn tracking device according to claim 1 wherein the means for implementing tamper detection is a strap attached to the case and worn around an ankle of the offender which if severed actuates an alarm to a central data base.

5. A body-worn tracking device according to claim 1 wherein the signaling device is a low profile vibrator.

6. A body-worn tracking device according to claim 1 wherein the field programmable gate array includes a processor and memory containing a schedule of rules and location constraints.

7. A body worn tracking device according to claim 1 wherein the wireless data modem communicates directly to remote associated devices selected from the group consisting of victim devices, central data base, supervisory agency and law enforcement.

8. The body-worn device according to claim 1 wherein the sealed enclosed case contains a backup battery to provide power to the circuit board if the main battery is discharged or during replacement.

9. The body-worn device according to claim 1 wherein the sealed enclosed case contains a wireless data modem to actively transmit the location of the body-worn device at current health and status frequent intervals.

10. The body-worn device according to claim 1 wherein the sealed enclosed case contains a wireless data modem to passively transmit the accumulated location movement history of the body-worn device at predetermined intervals.

11. A system for determining the spacial coordinates of an offender comprising attaching a tamper resistant body-worn tracking device to a limb of the offender, and sending signals directly from the body-worn tracking device to remote associated notification devices, the body-worn tracking device providing a sealed case containing:

(a) a main battery;

(b) a signaling device;

(c) a circuit board having attached to the board (1) a wireless data modem, (2) a GPS receiver having a means to acquire updates to a GPS almanac, (3) a matched filtering GPS receiver with an RF front end connected to the GPS receiver and matched filtering GPS receiver, and (4) a field programmable gate array;

the system including a central station computer in direct communication with the body-worn device, the computer containing an algorithm for comparing a current location of the body-worn tracking device to a schedule of rules and location restraints to determine if a violation has occurred.

12. The system according to claim 11 including direct communication to a victim's body-worn device to determine if a dynamic rule violation has occurred.

13. The system according to claim 11 wherein a low profile vibrator is provided as the signaling device.

14. The system according to claim 11 wherein the circuit board has additionally attached a battery monitoring circuit.

15. The system according to claim 11 wherein the sealed case contains a field programmable gate array comprising multiple integrated circuits for power saving.

16. The system according to claim 11 wherein the sealed case contains a passive tracking mode for reduced wireless communications and power savings.

* * * * *